US008998686B2

(12) United States Patent
Fischer et al.

(10) Patent No.: US 8,998,686 B2
(45) Date of Patent: Apr. 7, 2015

(54) APPARATUS AND METHOD FOR SORTING COINS

(75) Inventors: Arno Fischer, Linz (AT); Bruno Gruenberger, Engerwitzdorf (AT); Daniel Obermayr, Neuhofen (AT)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 14/009,356

(22) PCT Filed: Apr. 5, 2012

(86) PCT No.: PCT/EP2012/056264
§ 371 (c)(1),
(2), (4) Date: Jan. 28, 2014

(87) PCT Pub. No.: WO2012/136755
PCT Pub. Date: Oct. 11, 2012

(65) Prior Publication Data

US 2014/0194045 A1 Jul. 10, 2014

(30) Foreign Application Priority Data

Apr. 7, 2011 (DE) ..... 10 2011 001 870

(51) Int. Cl.
*G07D 3/00* (2006.01)
*G07D 3/14* (2006.01)

(52) U.S. Cl.
CPC ..... *G07D 3/14* (2013.01)

(58) Field of Classification Search
USPC ..... 453/7, 11, 56; 194/302, 334–338
See application file for complete search history.

(56) References Cited

U.S. PATENT DOCUMENTS

| | | | |
|---|---|---|---|
| 4,635,661 | A | 1/1987 | Uematsu et al. |
| 4,881,918 | A | 11/1989 | Goh et al. |

FOREIGN PATENT DOCUMENTS

| | | | |
|---|---|---|---|
| EP | 0209675 | A1 | 1/1987 |
| EP | 1020819 | A1 | 7/2000 |
| EP | 1450314 | A2 | 8/2004 |
| EP | 1657685 | A1 | 5/2006 |
| EP | 1808822 | A1 | 7/2007 |
| EP | 1927955 | A1 | 6/2008 |
| EP | 1450314 | B1 | 11/2010 |
| GB | 2254419 | A | 10/1992 |
| WO | WO-94-04997 | A1 | 3/1994 |

OTHER PUBLICATIONS

International Search Report (in English and German) and Written Opinion (in German) for PCT/EP2012/056264, mailed Jul. 26, 2012; ISA/EP.

International Preliminary Report on Patentability (Chapter I)(in English) for PCT/EP2012/056264, issued Oct. 8, 2013.

*Primary Examiner* — Jeffrey Shapiro
(74) *Attorney, Agent, or Firm* — Harness, Dickey & Pierce, P.L.C.

(57) ABSTRACT

The invention relates to a device for sorting coins, the diameter and thickness of which are within predefined size ranges.

8 Claims, 2 Drawing Sheets

APPARATUS AND METHOD FOR SORTING COINS

CROSS-REFERENCE TO RELATED APPLICATIONS

This application is a National Stage of International Application No. PCT/EP2012/056264, filed Apr. 5, 2012, and published in German as WO 2012/136755 A1 on Oct. 11, 2012. This application claims the benefit and priority of German Application No. 10 2011 001 870.0, filed Apr. 7, 2011. The entire disclosures of the above applications are incorporated herein by reference.

BACKGROUND

This section provides background information related to the present disclosure which is not necessarily prior art.

1. Technical Field

The invention relates to a device for sorting coins, the diameter and thickness of which are within predefined size ranges, containing a storage container for unsorted coins, containing at least one coin conveying unit having two parallel, jointly driven, endlessly circulating pulling means, wherein an upper run of the pulling means, that conveys the coins upwards from the storage container and is oriented such that it raises in a conveying direction, forms part of the wall of the storage container, with a sliding bar extended in the conveying direction for supporting the coins during conveying, wherein the sliding bar is arranged between the pulling means in the region of the upper run, and with coin receptacles for the conveyed coins, wherein the coin receptacles have driver pins provided on the pulling means and assigned to one another in pairs, which project beyond the sliding bar by an extent exceeding the predefined greatest coin thickness, containing a coin separating unit for separating the coins conveyed from the storage container in the coin receptacles, with a shearing device for coins lying axially above one another in the coin receptacles, wherein the sliding bar, as a shearing device, has a run-on ramp, the height of which is less than the projection of the driver pins beyond the sliding bar and greater than the difference between the projection of the driver pins and the smallest predefined coin thickness, and with a return device for coins lying radially above one another in the coin receptacles, wherein the return device has a signal generator for detecting an extension of the coins in the conveying direction and a returner arranged downstream of the signal generator for returning the coins from the coin receptacle into the storage container, containing a coin recognition unit arranged downstream of the coin separating unit, as seen in the conveying direction, for identifying different types of coins by means of at least one characteristic feature of the separated coins, and containing a discharge unit for the separated coins interacting with the coin recognition unit and being arranged downstream of the coin recognition unit, as seen in the conveying direction.

2. Discussion

The invention further relates to a method for sorting coins provided in an unsorted manner in a storage container, wherein the coins are conveyed out of the storage container by means of a coin conveying unit, wherein the coins are separated by means of a coin separating unit in such a manner that, in the coin receptacles of the coin conveying unit receiving the coins when conveyed, only one coin is provided respectively, and wherein a characteristic feature of the coins is detected in a coin recognition unit for identifying different types of coins.

A device of this type is known from EP 1 450 314 B1. The device is used for separating coins and is in particular applied in coin receiving machines. For example, after business opening hours, business people may use a self-service receiving machine for filling in unsorted coins into a funnel-shaped storage container. The entered coins are separated upon reception, identified with regard to their value and are counted. The overall amount of the coins may subsequently for example be credited to a business account of the user. After having been counted, the entered coins are stored in an unsorted manner in a single collection container, wherein in the collection container, coins from different users are stored jointly. Foreign currency coins and non-accepted means of payment such as buttons are sorted out and returned to the user. The collection container is for example emptied on a daily basis. After emptying the container, the coins collected in the collecting container are again separated and sorted. This can for example be carried out manually in the branch bank or in an automated manner in a central bank. Even though such receiving machines provided with the device for separating coins principally have proved their worth, it is desirable to simplify the return of the coins, which have been entered into the receiving machine, into the cash flow.

SUMMARY OF THE INVENTION

It is therefore an object of the invention to provide a device and a method for sorting coins in such a manner that the effort, which is made in order to reintroduce the coins, which have already been detected in respect to their value, into the cash flow, is reduced.

For solving this object, the invention in connection with an aspect of the invention is characterized in that the discharge unit is designed as a discharge unit for discharging coins of one single type and has at least one ejector, wherein the at least one ejector is controlled by a control unit in such a manner that the coins identified by the coin recognition unit are supplied to different collecting containers in accordance with the identified characteristic feature.

The invention is especially advantageous since, as a consequence of the single-type storage of the entered coins, it is not necessary to separate and identify the coins anew. The sorting takes place directly following the identification of the coins in the receiving machine itself. It is not necessary to manually sort the coins or separate and sort them anew in an automated manner, for example in a central bank, such that finally it is not necessary to transport the coins to a central bank.

As the coins are stored in corresponding collecting containers in a single-type manner, it is moreover possible to provide a coin recycling machine. By means of such recycling machine it is possible to subsequently dispense the coins having been entered before, having been sorted and stored in a single-type manner, to other users. Thus, on the one hand, the amount of coins having to be taken from the machine for transport to the branch bank or the central point of collection is reduced. On the other hand, such recycling machine can be operated without maintenance over a considerably longer period, since as a consequence of the payout of coins, the amount of coins stored is not growing as fast as in the case of pure receiving machines and an overload of the collecting containers can be prevented.

According to a preferred embodiment of the invention, a control unit interacts with a drive unit actuating the pulling means or respectively with a detection unit for detecting a conveying speed of the coins, with the coin recognition unit and the at least one ejector in such a manner that a point in time for actuating the ejector is determinable taking into consideration the conveying speed of the coins and a distance of the ejector from the coin recognition unit or another point of reference of the device. Advantageously, the point in time for actuating the ejector can especially exactly be determined by interrelating the actual conveying speed of the coins with the distance of the ejector from the coin recognition unit. The diameter of the coins to be sorted can serve as a further parameter for determining the time of actuation. In this way, it is taken account of the fact that after having left the coin recognition unit, coins having a great diameter reach an operating area of the ejector sooner than coins having a small diameter.

According to a further embodiment of the invention, a guiding unit is arranged between the at least one ejector and the collecting containers. By means of the guiding unit, the coins ejected from the coin receptacles are suppliable to the collecting containers. Advantageously, the guiding unit increases the accuracy of the sorting since by providing the guiding unit it can be prevented that sorting errors occur. The guiding unit may for example be provided with at least a guiding channel for the ejected coins, an inclined surface serving as a coin slide or a guiding tube adjusted to the diameter of the coins. In particular, by making use of the weight force, the coins can be passively guided in the guiding unit in the direction of the collecting containers.

According to a further embodiment of the invention, a plurality of ejectors is provided that are arranged in series in the conveying direction. Herein, the number of ejectors is in correspondence with the number of types of coins or the number of collecting containers, respectively. Advantageously, the sorting of the coins is performed in an highly accurate manner if exactly one ejector is provided for every type of coins. In such case, the ejector may be designed as a quasi-analogue ejector, which merely makes a difference between the operating conditions of "ejection" and "no ejection". Different operating conditions for ejecting different types of coins by means of one single ejector can be avoided and the risk of an erroneous sorting of the coins is reduced.

According to a further embodiment of the invention, in the conveying direction, a plurality of ejectors and a plurality of detectors are arranged in series in an alternating manner, wherein by means of the detectors it can be verified whether the coins are duly ejected. Advantageously, by providing detectors, each of which is provided downstream of an ejector, it can be reviewed if the ejectors function in an unobjectionable manner and an erroneous sorting can immediately be detected. This in particular applies where for each type of coins a separate ejector is provided. For example, detectors can be arranged immediately upstream of the respective ejectors. Advantageously, by means of the upstream detectors, the point in time for actuating the ejector can be determined exactly and occasionally depending on the conveying speed.

According to a further embodiment of the invention, the discharge unit comprises a plurality of discharge modules arranged in series in the conveying direction. Each of the discharge modules has an ejector and a detector downstream of the ejector and is assigned to exactly one collecting container. Advantageously, due to the modular design, the device can easily be adapted to the set of coins in different countries. For example by removing two modules, a device for sorting coins originally intended for use in the Euro zone and thus having eight discharge modules, namely for the 1 Cent coin, the 2 Cent coin, the 5 Cent coin, the 10 Cent coin, the 50 Cent coin, the 1 Euro coin and the 2 Euros coin, can be adapted to a currency area merely having six different types of coins. The effort that has to be made for the constructive adaptation of the device is limited, thus that consequently the production of the device is particularly cost-effective.

According to a further embodiment of the invention, the diameter of the coins is detected by the coin recognition unit as the characteristic feature of the coins. Advantageously, the diameter can for example be detected in a particular easy way by means of an optical sensor unit. There is only little risk of an erroneous detection. Comparative data for determining the types of coins by way of determining the diameter can for example be stored in the control unit.

According to a further embodiment of the invention, a material composition of the coins is detected as the characteristic feature of the coins. Advantageously, by detecting the material composition of the coins, an authenticity check of the coins can be performed. The material composition of the coins can for example be detected by an electromagnet alloy analysis. Consequently, it is possible to integrate the determination of value of the coins, in which an at least elementary authenticity check is required, as well as the sorting function in one single device. Hence, the constructive effort as well as the installation space requirements can be reduced.

For solving the object, the invention in connection with another aspect of the invention is characterized in that the coins are then separated in a single-type manner, wherein the coins are ejected from the coin receptacles and supplied to different collecting containers depending on the type of coin.

Advantageously, the coins can be supplied to a coin separating unit, a coin recognition unit and a unit for single-type sorting of the coins by means of one single coin conveying unit. Subsequently, the coins are stored in a single-type manner in individual collecting containers. On the one hand, after sorting, the coins can be dispensed anew for realizing a coin recycling machine. On the other hand, the effort made for post-treatment of the coins after their reception is reduced, since it is not necessary to separate the coins anew prior to their subsequent sorting.

BRIEF DESCRIPTION OF THE DRAWINGS

The drawings described herein are for illustrative purposes only of selected embodiments and not all possible implementations, and are not intended to limit the scope of the present disclosure.

Embodiments of the invention are outlined in more detail in the following with reference to the drawings.

The drawings comprise:

Figure 1:
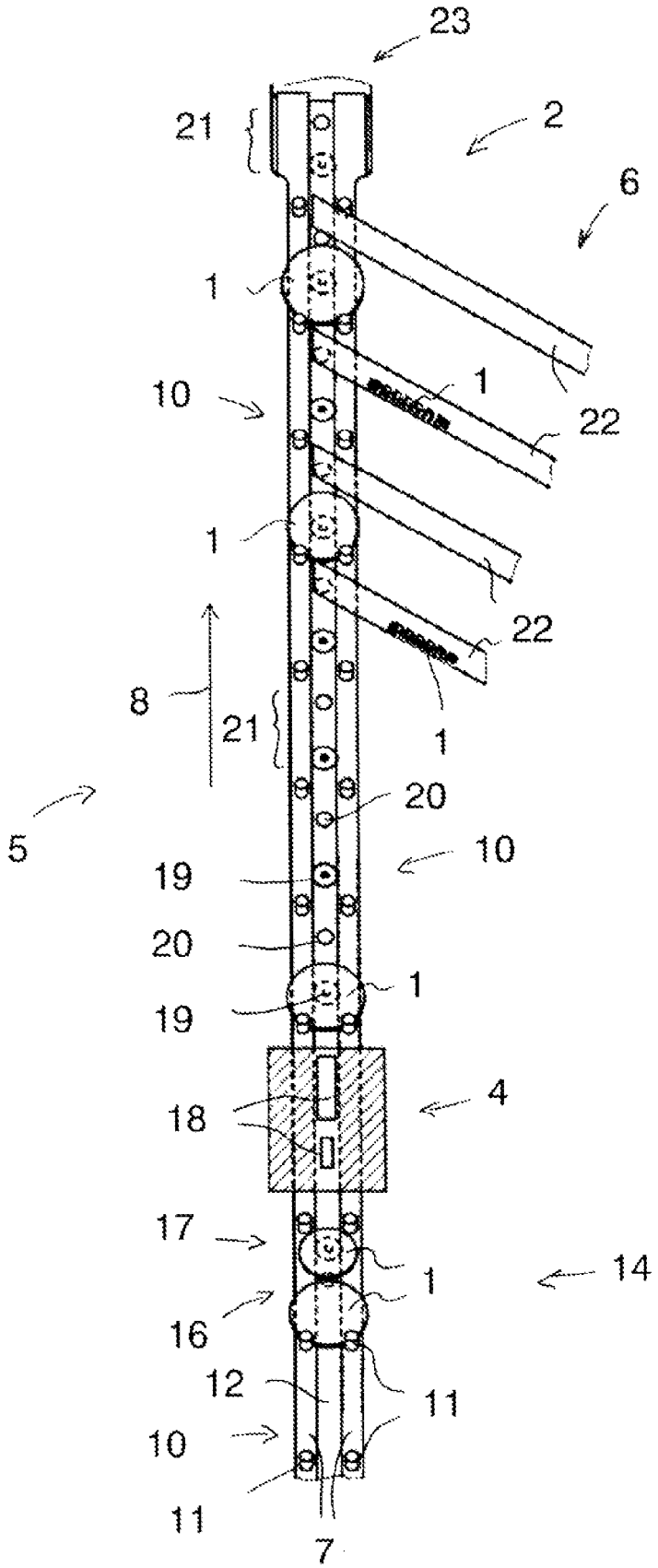
Figure 2:
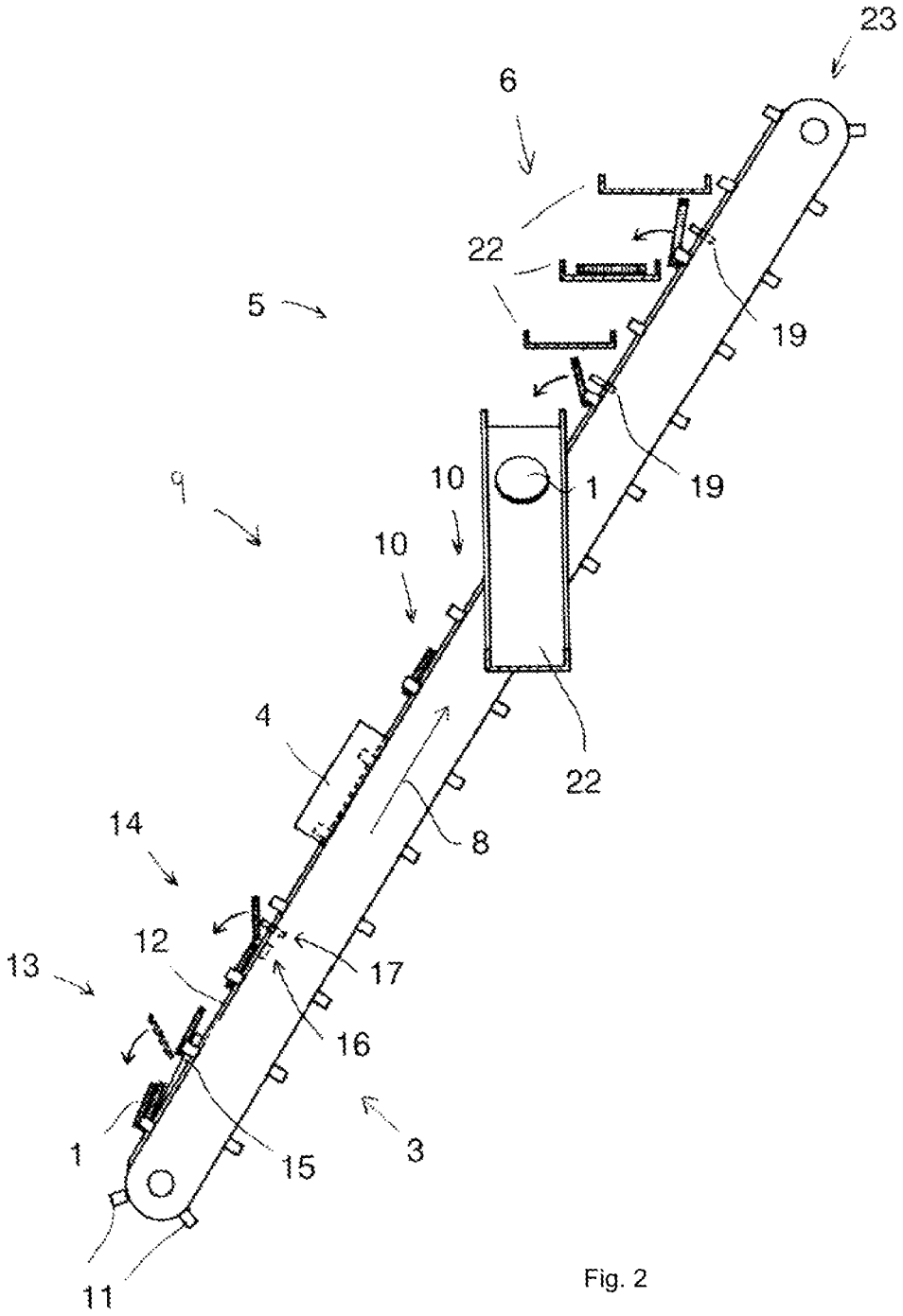

FIG. 1 a schematic illustration of a device for sorting coins in a top plan view and FIG. 2 a side view of the device according to FIG. 1.

Corresponding reference numerals indicate corresponding parts throughout the several views of the drawing.

DETAILED DESCRIPTION OF THE PREFERRED EMBODIMENTS

Example embodiments will now be described more fully with reference to the accompanying drawing.

Substantial functional units of a device for sorting coins 1 are a coin conveying unit 2 designed in the form of an inclined conveyor for the coins 1, a coin separating unit 3 for separating the coins 1 conveyed on the coin conveying unit 2, a coin recognition unit 4 for identifying different types of coins, a discharge unit 5 for single-type dischargement of the coins 1 as well as a guiding unit 6. Such device is for example used in coin receiving machines for separating, identifying and sorting coins 1 inserted by users in an unsorted manner. Herein, the receiving machine may for example be designed to be a self-service machine and be provided in a foyer of a bank. These self-service machines can be used by business people for depositing their daily receipts after business hours to have them credited to their business account.

The coin conveying unit 2 is used to convey unsorted coins 1 provided in a storage container, not illustrated, upwards out of the storage container. To this end, the coin conveying unit 2 has two parallely oriented, jointly driven, endlessly circulating pulling means 7. An upper run 9 of the pulling means 7 that conveys the coins 1 upwards from the storage container and that is oriented to raise in a conveying direction 8 herein defines part of the wall of the storage container.

On the conveying unit 2, the coins 1 are provided in a plurality of coin receptacles 10 arranged in series in the conveying direction 8. Each of the coin receptacles 10 has two driving pins 11 assigned to one another in pairs and provided on the pulling means 7 in a way so as to project therefrom. When being conveyed, the coins 1 radially abut on the driving pins 11. Furthermore, when being conveyed, the coins 1 are supported at an even side thereof by a sliding bar 12 extending in the conveying direction 8. The sliding bar 12 is arranged between the pulling means 7 in the region of the upper run 9. The driving pins 11 project beyond the sliding bar 12 by an extent exceeding the predefined greatest coin thickness.

It cannot be excluded that the coin conveying unit 2 in a single coin receptacle 10 conveys more than one coin 1 out of the storage container. Therefore, the coin separating unit 3 is assigned to the coin conveying unit 2 in a lower region thereof. For separating the coins 1 conveyed out of the storage container, the coin separating unit 3 has a shearing device 13 as well as a return device 14 in the coin receptacles 10.

The shearing device 13 serves for separating coins 1 lying axially above one another in the coin receptacles 10. The shearing device 13 is constituted by a run-on ramp 15 assigned to the sliding bar 12. The run-on ramp 15 is designed to protrude as against the sliding bar 12, wherein a height of the run-on ramp 15 raising in the conveying direction 8 is smaller than the projection of the driving pins 11 beyond the sliding bar 12 and greater than the difference between the projection of the driving pins and the smallest predefined coin thickness. Consequently, when conveying the coins 1 over the run-on ramp 15, a coin 1 immediately abutting on the sliding bar 12 is held safely by driving pins 11 in the coin receptacle 10 and conveyed in the conveying direction 8 also in the region of the run-on ramp 15. If, however in the same coin receptacle 10, a second coin 1 lies axially above the first coin 1, it may no longer be radially supported by the driving pins 11 in the region of the run-on ramp 15 so that consequently it is transported back into the storage container in a direction opposite to the conveying direction 8.

As seen in the conveying direction 8, the return device 14 is arranged downstream of the shearing device 13. The substantial parts of the return device 14 are a signal generator 16 and a returner 17 arranged downstream of the signal generator 16. The signal generator 16 serves to detect the extension of the coins 1, which are conveyed in the coin receptacle 10, in the conveying direction 8. If the extension of the coins 1 in the conveying direction 8 is greater than the maximum coin diameter, it can be concluded that, as seen in the conveying direction 8, in one single coin receptacle 10 two or more coins 1 are arranged in series. In this case, the surplus coins 1 conveyed are returned back into the storage container from the coin receptacles 10 by means of the returner 17.

The coin recognition unit 4 arranged downstream of the coin separating unit 3, as seen in the conveying direction 8, serves to identify different types of coins by means of at least one characteristic feature of the coins 1. In the present case, the diameter of the coins 1 is detected by means of an optical sensor unit 18.

The discharge unit 5 arranged downstream of the coin recognition unit 4, as seen in the conveying direction 8, has a plurality of ejectors 19 and detectors 20 which, as seen in the conveying direction 8, are provided in series and arranged in the sliding bar 12. In the conveying direction 8, ejectors 19 and detectors 20 are arranged in series in an alternating manner, wherein, as seen in the conveying direction 8, a detector 20 is arranged downstream of every ejector 19. The ejectors 19 serve to eject the coins 1, which are conveyed in the coin receptacles 10, out of the coin receptacles 10 and to supply them to the guiding unit 6. The detectors 20 are provided in order to verify whether the coins 1 are duly ejected. Herein, the discharge unit 5 is constituted to be a modular discharge unit 5 having a plurality of discharge modules 21 arranged in series in the conveying direction 8. Every discharge module 21 has an ejector 19 and a detector 20 arranged downstream of the ejector 19. As seen in the conveying direction 8, seven discharge modules 21 are arranged in series. Every discharge unit 21 serves to eject exactly one type of coins from out of the coin receptacles 10 of the coin conveying unit 2. To this end, exactly one guiding channel 22 of the guiding unit 6, that serves as guiding means for the ejected coins 1, is assigned to every discharge module 21, wherein for clarity reasons not all of these seven guiding channels 22 are illustrated and wherein the construction and function of the guiding unit 6 is outlined in principle by way of example of four guiding channels 22.

Along the guiding channels 22 of the guiding unit 6, the coins 1 of one single type slide into a respective collecting container not shown. Insofar, exactly one guiding channel 22 and one collecting container is assigned to every discharge module 21. In the collecting containers the coins 1 can be provided to be of one single type, however unsorted or of one single type in a geometrical order, for example as a stack of coins. To this end, the collecting containers can be constructed for example to have a tubular shape, wherein an inner diameter of the collecting containers is adjusted to the diameter of the respective type of coins to be stored.

Instead of the illustrated guiding channels 22 supporting the coins 1 at their even surface, the guiding unit 6 can be provided with guiding means having a V-shaped cross section or a bent cross section of any other type for forming a hollow guide. Instead of the U-shaped open-top cross section of the guiding channel 22, the guiding unit 6 can be provided with guiding means having a closed cross sectional profile, in particular with circular guiding means.

After having left the coin recognition unit 4, the coins 1 having been conveyed out of the storage container and having been separated by means of the coin separating unit 3 and having been identified by the coin recognition unit 4 are moved into the operating area of the discharge unit 5. They are conveyed by the coin conveying unit 2 until they reach the operating area of the ejector 19 predefined for the respective type of coins. When the coin 1 reaches the operating area of the ejector 19 which it is assigned to, it is ejected thereby from the coin receptacle 10 and, via the guiding channel 22 the ejector 19 is assigned to, is supplied to the collecting container provided for storing the respective type of coins. By means of the detector 20 arranged immediately downstream of the ejector 19 it can be verified whether the coin 1 has correctly been discharged.

Where, in exceptional cases, coins 1 are conveyed that cannot be identified by means of the coin recognition unit 4, the coins 1 are conveyed beyond all discharge modules 21 to reach a further collecting container via an upper discharge end 23 of the coin conveying unit 2. Those coins may for example be re-dispensed to the user from the further collecting container.

For exactly determining the point in time for actuating the ejector 19, the ejectors 19 are controlled by a control unit not illustrated. On the one hand, the control unit interacts with the coin recognition unit 4. Thus, it is determined which one of the ejectors 19 has to be controlled in order to discharge a type of coins identified by the coin recognition unit 4. Further, the control unit may interact with a detection unit not shown for detecting a conveying speed of the coins 1. The conveying speed of the coins 1 being known, the point in time for actuating the ejector 19 can be determined under consideration of both the conveying speed and the distance of the ejector 19 from the coin recognition unit 4 or from any other—preferably stationary—point of reference of the device. Moreover, the coin diameter of the type of coins respectively to be ejected can be taken into consideration in determining the point in time of ejection. The conveying speed can be detected for example by means of suitable sensors or can be established by an interaction of the control unit with a drive unit for the pulling means 7 not shown.

In an alternative embodiment that has not been illustrated, the point in time for actuating the ejector can be determined by a detector 20 arranged upstream of the respective ejector 10. The detector 20, which is preferably situated in the region of the sliding bar 12 in immediate proximity of the ejector 19 which is assigned to it, can signalize the immediately imminent entrance of the coin 1 into the operating area of the ejector 19 and trigger the ejector 19 with a time delay that has been predefined or is determinable in a further parameter.

In this embodiment, the detector 20 arranged downstream of an ejector 19 that is not the last one, can have two functions. On the one hand, the downstream detector 20 can function as a trigger for the ejector 19 that comes next in the conveying direction 8. Moreover, it can be used to verify the correct ejection of a coin 1 by means of the ejector 19 that is arranged upstream thereof.

Identical components and functions of components of the different embodiments are provided with identical reference signs.

By means of the discharge unit 5 more than one coin 1 can be ejected at the same time. This applies where coins 1 in different coin receptacles 10 substantially simultaneously reach the operating area of different ejectors 19. For reliably preventing an erroneous sorting, it is necessary that, where a plurality of ejectors 19 is provided, each of the ejectors 19 is individually controllable by the control unit.

According to the illustrated embodiment of the invention, an authenticity check of the coins 1 by means of the device according to the invention is dispensed with. Such authenticity check can be carried out in combination with a value-related detection of the entered coins 1 by means of a separate device. For example a coin separating device known from prior art can be arranged upstream of the device according to the invention. However, in this case—instead of storing the separated coins, the value of which has been determined and the authenticity of which has been verified, after separation in a collecting container until they are removed from the receiving machine—the coins are supplied to the storage container of the device according to the invention to subsequently be sorted in a single-type manner. It is also possible to integrate, for example in the region of the recognition unit 4, a sensor system for examining the authenticity of the coins 1—for example by means of an electromagnetic alloy analysis—into the device according to the invention, such that the provision of two separate devices can be dispensed with.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for sorting coins, the diameter and thickness of which are within predefined size ranges, said device comprising:

a storage container for unsorted coins, at least one coin conveying unit having two parallel, jointly driven, endlessly circulating pulling means, wherein an upper run of the pulling means, that conveys the coins upwards from the storage container and is oriented such that it raises in a conveying direction, forms part of the wall of the storage container, with a sliding bar extended in the conveying direction for supporting the coins during conveying, wherein the sliding bar is arranged between the pulling means in the region of the upper run and at least one coin receptacle for the conveyed coins, wherein the coin receptacles have driver pins provided on the pulling means and assigned to one another in pairs, which project beyond the sliding bar by an extent exceeding the predefined greatest coin thickness, a coin separating unit for separating the coins conveyed from the storage container in the coin receptacles, with a shearing device for coins lying axially above one another in the coin receptacles, wherein the sliding bar, as a shearing device, has a run-on ramp, the height of which is less than the projection of the driver pins and the smallest predefined coin thickness, and with a return device for coins lying radially above one another in the coin receptacles, wherein the return device has a signal generator for detecting an extension of the coins in the conveying direction and a returner arranged downstream of the signal generator for returning the coins from the coin receptacle into the storage container, a coin recognition unit arranged downstream of the coin separating unit, as seen in the conveying direction, for identifying different types of coins by means of at least one characteristic feature of the separated coins, and a discharge unit for the separated coins interacting with the coin recognition unit and being arranged downstream of the coin recognition unit, as seen in the conveying direction, wherein the discharge unit is designed as a discharge unit for discharging coins of one single type and has at least one ejector, wherein the at least one ejector is controlled by a control unit in such a manner that the coins identified by the coin recognition unit are supplied to different collecting containers in accordance with the identified characteristic feature.

2. The device according to claim 1, wherein a control unit interacts with a detection unit for detecting a conveying speed of the coins, with the coin recognition unit and the at least one ejector in such a manner that a point in time for actuating the ejector is determinable under consideration of the conveying speed of the coins and/or of a distance of the ejector from the coin recognition unit and/or of the coin diameter.

3. The device according to claim 1, wherein a guiding unit is arranged between the ejector and the collecting containers, by means of which the coins ejected from the coin receptacles are suppliable to the collecting containers.

4. The device according to claim 1, wherein a plurality of ejectors is provided that are arranged in series in the conveying direction, wherein the number of ejectors is in correspondence with the number of types of coins.

5. The device according to claim 1, wherein in the conveying direction, a plurality of ejectors and a plurality of detectors are arranged in series in an alternating manner, wherein by means of the detectors it can be verified whether the coins are duly ejected.

6. The device according to claim 1, wherein the discharge unit has a plurality of discharge modules arranged in series in the conveying direction, wherein each of the discharge modules has an ejector and a detector arranged downstream of the ejector and wherein exactly one collecting container is assigned to each of the discharge modules.

7. The device according to claim 1, wherein as the characteristic feature of the coins, the diameter of the coins is detected by the coin recognition unit.

8. The device according to claim 1, wherein as the characteristic feature of the coins, a material composition of the coins is detected.

* * * * *